US009768493B2

(12) United States Patent
Neinhues

(10) Patent No.: US 9,768,493 B2
(45) Date of Patent: Sep. 19, 2017

(54) DIRECTIONAL ANTENNA MODULE

(71) Applicant: Rohde & Schwarz GmbH & Co. KG, München (DE)

(72) Inventor: Markus Neinhues, Kirchseeon (DE)

(73) Assignee: ROHDE & SCHWARZ GMBH & CO. KG, Munich (DE)

( * ) Notice: Subject to any disclaimer, the term of this patent is extended or adjusted under 35 U.S.C. 154(b) by 0 days.

(21) Appl. No.: 15/226,935

(22) Filed: Aug. 3, 2016

(65) Prior Publication Data

US 2017/0040672 A1 Feb. 9, 2017

(30) Foreign Application Priority Data

Aug. 3, 2015 (EP) ..... 15179508

(51) Int. Cl.

| | |
|---|---|
| ***H01Q 1/24*** | (2006.01) |
| ***H01P 1/213*** | (2006.01) |
| ***H01Q 1/42*** | (2006.01) |
| ***H01Q 7/00*** | (2006.01) |
| ***H01Q 11/10*** | (2006.01) |
| ***H01Q 21/30*** | (2006.01) |
| ***H01Q 5/50*** | (2015.01) |
| ***H01Q 21/06*** | (2006.01) |
| *H01Q 1/27* | (2006.01) |

(52) U.S. Cl.

CPC ..... *H01Q 1/243* (2013.01); *H01P 1/213* (2013.01); *H01Q 1/42* (2013.01); *H01Q 5/50* (2015.01); *H01Q 7/00* (2013.01); *H01Q 11/10* (2013.01); *H01Q 21/062* (2013.01); *H01Q 21/30* (2013.01); *H01Q 1/273* (2013.01)

(58) Field of Classification Search

CPC ..... H01Q 1/24; H01Q 7/00

USPC ..... 343/702

See application file for complete search history.

(56) References Cited

U.S. PATENT DOCUMENTS

| | | | | |
|---|---|---|---|---|
| 3,478,360 A * | 11/1969 | Hirsch | G01S 1/02 | 324/76.83 |
| 5,734,352 A * | 3/1998 | Seward | H01Q 5/321 | 343/715 |
| 5,784,683 A * | 7/1998 | Sistanizadeh | H04L 65/4076 | 348/E7.051 |
| 7,626,557 B2 * | 12/2009 | Eckwielen | H01Q 1/085 | 343/727 |

(Continued)

FOREIGN PATENT DOCUMENTS

| | | |
|---|---|---|
| DE | 2 262 511 | 7/1973 |
| GB | 894962 | 4/1962 |

OTHER PUBLICATIONS

Extended European Search Report for European Application No. 15179508.5 (Jan. 26, 2016).

(Continued)

*Primary Examiner* — Huedung Mancuso

(74) *Attorney, Agent, or Firm* — Jenkins, Wilson, Taylor & Hunt, P.A.

(57) ABSTRACT

Directional antenna module (1) comprising at least two directional antennae (2-1, 2-2), contained in a housing (12) of the directional antenna module (1), for adjacent frequency ranges, wherein the directional antennae (2-1, 2-2) are connected to a passive frequency multiplexing unit (5), which multiplexes the antenna signals received from the directional antennae in the various frequency ranges into a wideband signal.

12 Claims, 5 Drawing Sheets

(56) References Cited

U.S. PATENT DOCUMENTS

| | | | | |
|---|---|---|---|---|
| 7,911,406 | B2 * | 3/2011 | Eckwielen | H01Q 1/1228 343/833 |
| 2001/0044290 | A1 * | 11/2001 | Bobier | H01Q 1/246 455/301 |
| 2002/0149534 | A1 * | 10/2002 | Bobier | H01Q 1/525 343/841 |
| 2005/0088301 | A1 * | 4/2005 | Abbruscato | B60R 25/00 340/539.32 |
| 2012/0182191 | A1 | 7/2012 | King | |

OTHER PUBLICATIONS

"Technical Reference Manual DF-A0047 & DF-A0047-10," Alaris Antennas (PTY) Ltd., http://www.alarisantennas.com/upload/brochure_files/20151026100122_DF-A0047--DF-A0047-10_TRM-v3.3.pdf, pp. 1-28 (Jan. 11, 2013).

* cited by examiner

State of the Art

DIRECTIONAL ANTENNA MODULE

PRIORITY CLAIM

This application claims the benefit of European Patent Application No. 15179508.5, filed Aug. 3, 2015; the disclosure of which is incorporated herein by reference in its entirety.

TECHNICAL FIELD

The invention relates to a directional antenna module which supplies a wideband signal for a receiver or spectrum analyser connected thereto.

TECHNICAL BACKGROUND

A directional antenna is an antenna which, as a receiving antenna, has a maximum sensitivity in a particular direction. As receiving antennae, directional antennae have a non-isotropic or anisotropic directional characteristic, in other words they have a directional effect. This directional effect can be described quantitatively by the directional factor. The directional characteristic of an antenna can be specified more precisely in an antenna diagram or directional diagram. Similarly to microphones, antennae have different antenna characteristics, for example omnidirectional, cardioid or bidirectional characteristics, as well as lobe characteristics or cardioid-like directional characteristics. In a directional diagram or antenna diagram, directional characteristics of antennae are preferably shown horizontally and vertically in polar coordinates, and specify an angle-dependent antenna gain relative to a maximum signal gain. Directional antennae have a highly anisotropic directional characteristic having a high directional factor, and have a narrow full width at half maximum of the beam angle and a high forward-backward ratio FBR.

Directional antennae can be used in various frequency bands. The configuration and viability of directional antennae depends on the wavelength range used, since the directional characteristic of the directional antenna is dependent on the geometric dimensions of the directional antenna in relation to the wavelength of the received signal.

Directional antennae are formed in particular as portable devices, preferably as portable directional antenna modules, which can be coupled to a receiver. The directional antenna module is guided manually by a user so as to target or locate a signal source, in particular an interfering signal source, in the relevant frequency range. In conventional devices, various directional antenna modules which cover different frequency ranges are mounted for example on a solid handle. By changing out the various directional antenna modules, it is possible to locate signal sources in different frequency ranges. For example, in the conventional Rohde & Schwarz HE300 directional antenna receiver, there is a total of four exchangeable directional antenna modules each having a directional antenna, which together cover a frequency range of 9 kHz to 7.5 GHz. However, it is necessary to change a module of the directional antenna module at a frequency of 20 MHz, 200 MHz and 500 MHz. Since changing out directional antenna modules is relatively laborious for the user to cover a wide frequency range, it has been proposed to accommodate two directional antennae together in a housing and to switch between these directional antennae. FIG. 1 is a simple block diagram of a directional antenna module RA-MOD in which two directional antennae RA are provided in a housing. In the conventional directional antenna module RA-MOD, the two directional antennae RA1, RA2 shown in FIG. 1 are connected to a switch S which can be actuated by a user. In the conventional directional antenna module RA-MOD, a user can switch between the two directional antennae RA1, RA2 by actuating the switch S so as to change the receiving frequency range. For example, in the portable directional antenna module DF-A0047 from Alaris Antennas, the user has to switch manually to the other directional antenna at a frequency of 500 MHz so as to obtain a sufficient signal gain for the antenna received signal.

Operating errors can occur in the aforementioned directional antennae modules. In exchangeable directional antenna modules, it is possible for an incorrect directional antenna for a frequency range to be attached.

The conventional directional antenna module RA-MOD shown in FIG. 1 makes it necessary for the user, in particular in the case of weak received signals, to switch to the other directional antenna manually, starting at the latest from a particular boundary frequency between two adjacent frequency ranges, for example in a narrow overlap range at approximately 500 MHz. The user can derive this instruction for example from a datasheet included with the directional antenna module upon delivery. Thus, one possible source of error during measurement is that the user either does not have access to this information during the measurement process or is not even aware that it is necessary to switch between different directional antennae at a particular boundary frequency. If the user neglects to switch to the other directional antenna, it may therefore occur, in particular for relatively weak received signals, that the measurement using the directional antenna module leads to an excessively weak received signal and the measurement or location thus fails.

Therefore, there is a need to provide a directional antenna module which overcomes the aforementioned drawbacks and makes possible reliable measurement over a total frequency range spanning a plurality of frequency ranges.

SUMMARY OF THE INVENTION

The invention provides a directional antenna module comprising at least two directional antennae, contained in a housing of the directional antenna module, for adjacent frequency ranges, the directional antenna modules being connected to a passive frequency multiplexing unit, which multiplexes the antenna signals received from the directional antennae in the various frequency ranges into a wideband signal.

Thus, in the directional antenna module according to the invention, there is no longer any need for the user consciously to switch or reconnect manually between different directional antennae. This has the advantage that the user does not have to derive boundary frequencies between different frequency ranges from a datasheet, for example. Using the directional antenna module according to the invention, it is thus possible to receive different frequency bands continuously without any manual switching.

The directional antenna module according to the invention is preferably constructed to be purely passive, and in particular does not have an electronic switching logic or the like. Therefore, the directional antenna module according to the invention has the additional advantage that it is particularly robust against environmental influences. A further advantage of the directional antenna module according to the invention over conventional directional modules is that it is not necessary to replace the directional antenna module with a different directional antenna module so as to cover a very wide frequency range of for example 10 MHz to 10 GHz.

In a possible embodiment of the directional antenna module according to the invention, the directional antenna module has a substantially cardioid-like directional characteristic continuously over the various frequency ranges.

In a possible embodiment of the directional antenna module according to the invention, the passive frequency multiplexing unit has input gates for the antenna signals received by the directional antennae and an output gate for emitting the wideband signal.

In a possible embodiment of the directional antenna module according to the invention, a signal receiver or a spectrum analyser for evaluating the wideband signal is directly connectable to the output gate of the passive frequency multiplexing unit. In a possible embodiment, the directional antenna module can be attached to a handle and be interconnected with the receiver.

In a further possible embodiment of the directional antenna module according to the invention, a first directional antenna for receiving a VHF signal and a second directional antenna for receiving a UHF signal are contained in the directional antenna module, in the housing of the directional antenna module.

In a further possible embodiment of the directional antenna module according to the invention, the first directional antenna comprises a loop antenna.

In a further possible embodiment of the directional antenna module according to the invention, the first directional antenna comprises a dipole antenna array.

In a further possible embodiment of the directional antenna module according to the invention, the second directional antenna is a logarithmic-periodic antenna.

In a further possible embodiment of the directional antenna module according to the invention, the first directional antenna is connected to a first input gate of the passive frequency multiplexing unit, and the second directional antenna is connected to a second input gate of the passive frequency multiplexing unit.

In a further possible embodiment of the directional antenna module according to the invention, the passive frequency multiplexing unit is a diplexer, the transition frequency of which corresponds to the boundary frequency of the adjacent frequency ranges.

In a further possible embodiment of the directional antenna module according to the invention, the passive frequency multiplexing unit comprises a low-pass filter and a high-pass filter.

In this case, the low-pass filter is provided for low-pass filtering of the antenna signal received from the first directional antenna via the first input gate, and the high-pass filter is provided for high-pass filtering of the antenna signal received from the second directional antenna via the second input gate.

In a further possible embodiment of the directional antenna module according to the invention, a transformer for connecting the first directional antenna is provided between the first input gate of the passive frequency multiplexing unit and the low-pass filter.

In a further possible embodiment of the directional antenna module according to the invention, the passive frequency multiplexing unit comprises a compensation unit for compensating transit time differences between the antenna signals of the two directional antennae at the input gates of the passive frequency multiplexing unit.

In a further possible embodiment of the directional antenna module according to the invention, the loop antenna which forms the first directional antenna of the directional antenna module is interconnected with a resistor which gives the loop antenna the directional characteristic thereof.

In a further possible embodiment of the directional antenna module according to the invention, the first directional antenna and the second directional antenna are provided in a shared portable plastics material housing.

BRIEF DESCRIPTION OF FIGURES

In the following, possible embodiments of the directional antenna module are described in greater detail with reference to the accompanying drawings.

DETAILED DESCRIPTION OF EMBODIMENTS

Figure 2:
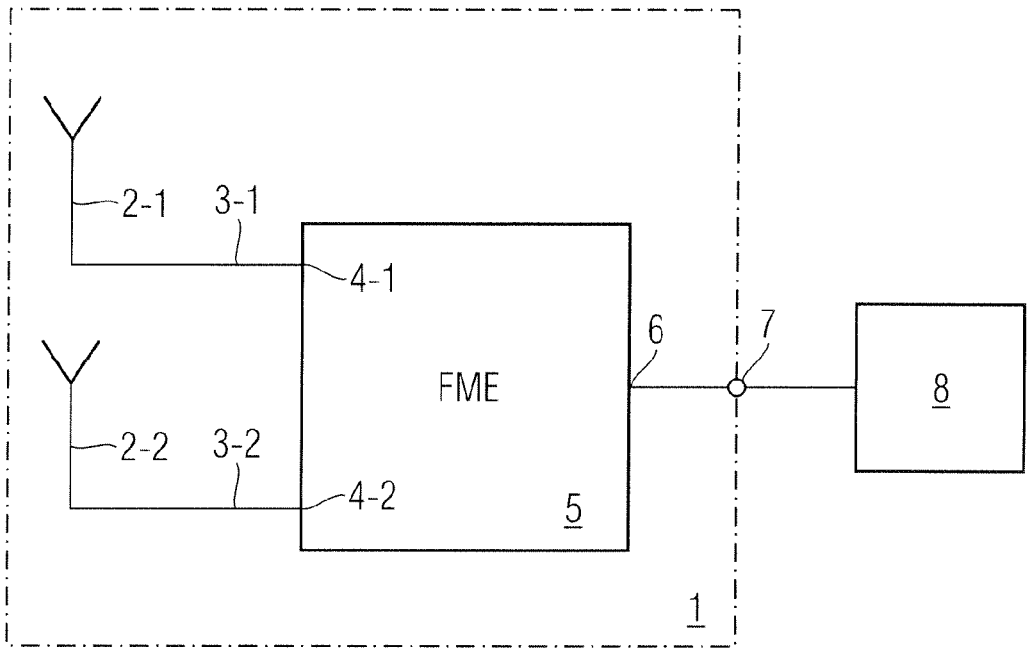
FIG. 2 is a block diagram of a possible embodiment of a directional antenna module according to the invention.

As can be seen from FIG. 2, in the embodiment shown, the directional antenna module 1 according to the invention comprises two directional antennae 2-1, 2-2, contained in a housing of the directional antenna module 1, for adjacent frequency ranges. The two directional antenna modules 2-1, 2-2 are connected via antenna signal lines 3-1, 3-2 to input gates 4-1, 4-2 of a passive frequency multiplexing unit 5, which multiplexes the antenna signals received from the two directional antennae 2-1, 2-2 in the various frequency ranges into a wideband signal and emits them via an output gate 6 and a directional antenna module terminal 7 to a signal evaluation unit 8. The signal evaluation unit 8 may be a signal receiver or for example a spectrum analyser. The signal evaluation unit 8 is connectable to the directional antenna module 1. In a possible embodiment, the directional antenna module 1 is attached to a handle which is connected to the signal evaluation unit 8. The two directional antennae 2-1, 2-2 are preferably provided in or integrated into a shared portable plastics material housing. In the example shown, the two directional antennae 2-1, 2-2 are provided for adjacent frequency ranges. In a possible embodiment, the first directional antenna 2-1 is configured to receive a VHF signal and the second directional antenna 2-2 is configured to receive a UHF signal. In a possible embodiment, the first directional antenna 2-1 is a loop antenna. Alternatively, a dipole antenna array may also be provided as the first directional antenna 2-1. In a possible embodiment, the second directional antenna 2-2 is a logarithmic-periodic antenna.

In a possible embodiment, the passive frequency multiplexing unit 5 may be formed by a diplexer, the transition frequency of which corresponds to the boundary frequency of the adjacent frequency ranges. In a possible embodiment, the passive frequency multiplexing unit 5 contains a low-pass filter for low-pass filtering of the antenna signal received from the first directional antenna 2-1 via the first input gate 4-1 and a high-pass filter for high-pass filtering of the antenna signal received from the second directional antenna 2-2 via the second input gate 4-2.

Figure 3:
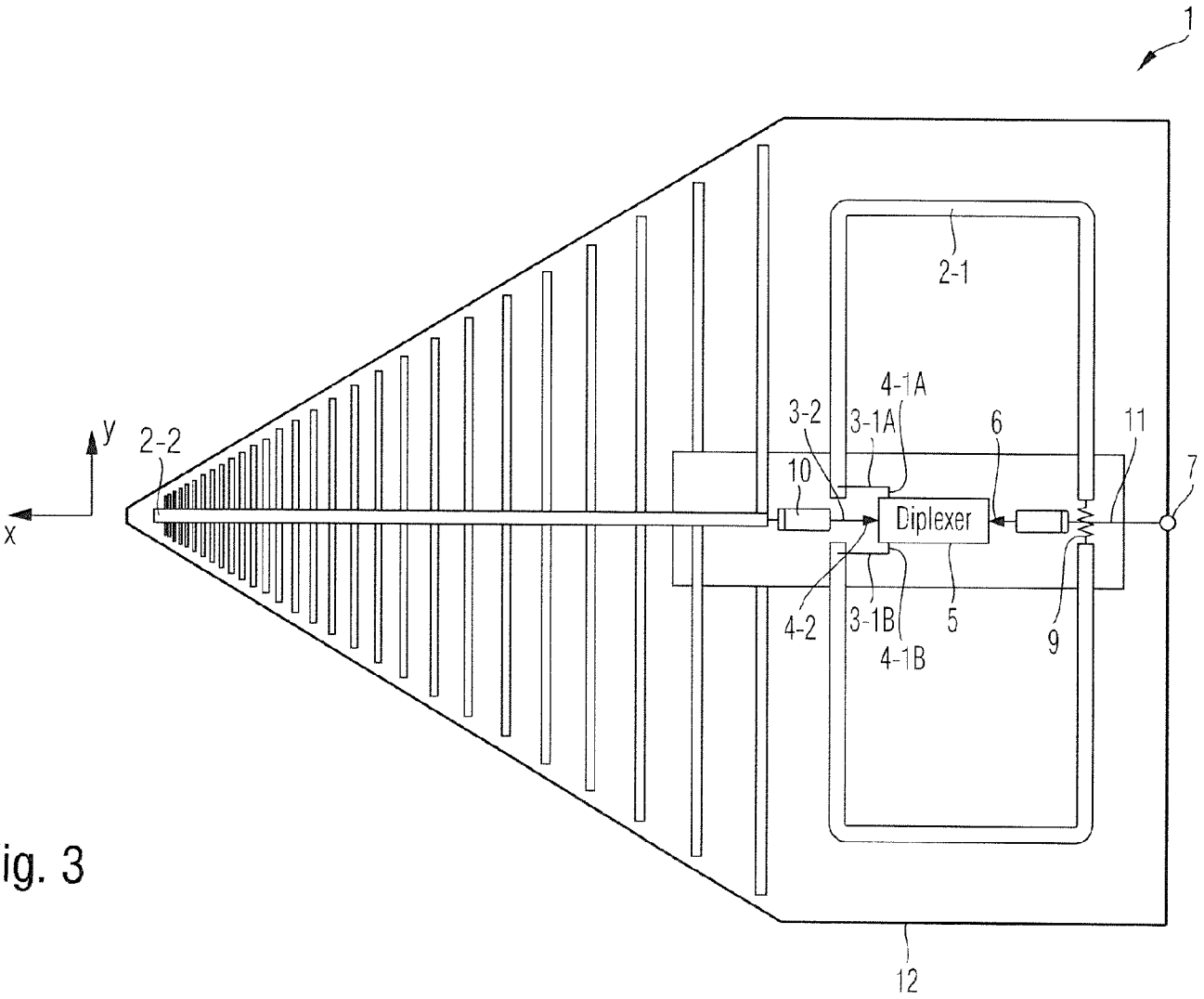
FIG. 3 shows a possible embodiment of a directional antenna module according to the invention.

FIG. 3 shows an embodiment of the directional antenna module 1 according to the invention shown in FIG. 2. In the embodiment shown, the first directional antenna 2-1 is formed by a loop antenna. This loop antenna 2-1 is interconnected with a resistor 9 which gives the loop antenna a directional characteristic. As a result of the interconnection with the resistor 9, the loop antenna becomes a loaded loop antenna having a directional characteristic. In the coordinate system shown in FIG. 3, the boresight direction extends in the x-direction, the loop antenna 2-1 preferably extending as long as possible inside the housing transverse to the boresight direction x, in other words in the y-direction. The loop antenna 2-1 is as elongate as possible for a given area enclosed by the loop antenna, so as to achieve maximum compactness of the directional antenna module 1. The thickness of the loop antenna 2-1 is further preferably optimised in terms of impedance. In a possible embodiment, the loaded loop antenna 2-1 is configured in such a way that it is suitable for receiving a VHF signal (very-high-frequency signal) for example in arrange of 20 MHz to 500 MHz.

In the embodiment shown in FIG. 3, the passive frequency multiplexing unit 5 of the directional antenna module 1 is formed by a diplexer. The diplexer 5 is a passive assembly which has three gates. The diplexer 5 is able to combine high-frequency waves and emit them via the output gate 6 thereof. As is shown in FIG. 3, a second directional antenna 2-2 for an adjacent frequency range is connected to the other input gate 4-2 of the diplexer 5 via an internal cable 10. In the embodiment shown, the second directional antenna 2-2 is a logarithmic-periodic antenna, which is configured for receiving a UHF (ultra-high-frequency) signal for example in a frequency range of 500 MHz to approximately 10 GHz.

In the embodiment shown in FIG. 3, the loop antenna 2-1 provided for the VHF frequency range and the logarithmic-periodic antenna 2-2 provided for the UHF frequency range are connected to the diplexer 5, which multiplexes the antenna signals received from the two directional antenna 2-1, 2-2 into a wideband signal, which is passed via an output gate 6 of the diplexer 5 via an internal cable line, in particular a coaxial cable 11, to the output terminal 7 of the directional antenna module 1. The transition frequency of the diplexer 5 preferably corresponds to the boundary frequency of the adjacent frequency ranges. For example, the boundary frequency is between the VHF frequency range covered by the loop antenna 2-1 and the UHF frequency range covered by the logarithmic-periodic antenna 2-2, at 500 MHz. The transition frequency of the diplexer 5, in other words the frequency at which the low-pass signal path starts to block and the high-pass signal path starts to conduct, is preferably adapted to the narrow overlap region of the individual directional antennae. The gradient of the individual filters or of the high-pass filter and the deep-pass filter is preferably particularly high in this frequency range. When a diplexer 5 is used, the blocking effect between the different input signal paths is particularly strong. As a result, the different individual directional antennae are largely decoupled out of band, in such a way that destructive overlaps due to periodically recurring effects, in particular in the loop antenna, are prevented. In the directional antenna module 1 according to the invention, the overlapping frequency ranges in which the two directional antennae 2-1, 2-2 simultaneously have a pronounced pattern in the boresight direction are small, so as to prevent destructive overlaps which occur during the summation by the diplexer 5. Further, the directional antenna module 1 according to the invention is preferably configured in such a way that an overlap range of less than zero, for which there is a gap in the boresight direction, is likewise also prevented. In a possible embodiment, the distance between the two directional antennae 2-1, 2-2 is optimised, in such a way that an influence on the loop antenna 2-1 from the logarithmic-periodic antenna 2-2 is largely prevented and pattern cancellations thus cannot occur. The diplexer 5 is further configured in such a way that it is continuously adapted to the sum output or output gate 6 thereof. This preferably takes into account the impedances of the individual directional antennae 2-1, 2-2. As is shown in FIG. 3, the two directional antennae 2-1, 2-2 are preferably accommodated in a shared housing 12, which preferably consists of plastics material.

The directional antenna module 1 according to the invention is preferably constructed to be passive, in such a way that it is also particularly insensitive to external influences. The directional antenna module 1 according to the invention is preferably configured in such a way that the weight thereof is minimal and the directional antenna module 1 can easily be carried and pivoted by a user.

Figure 4:
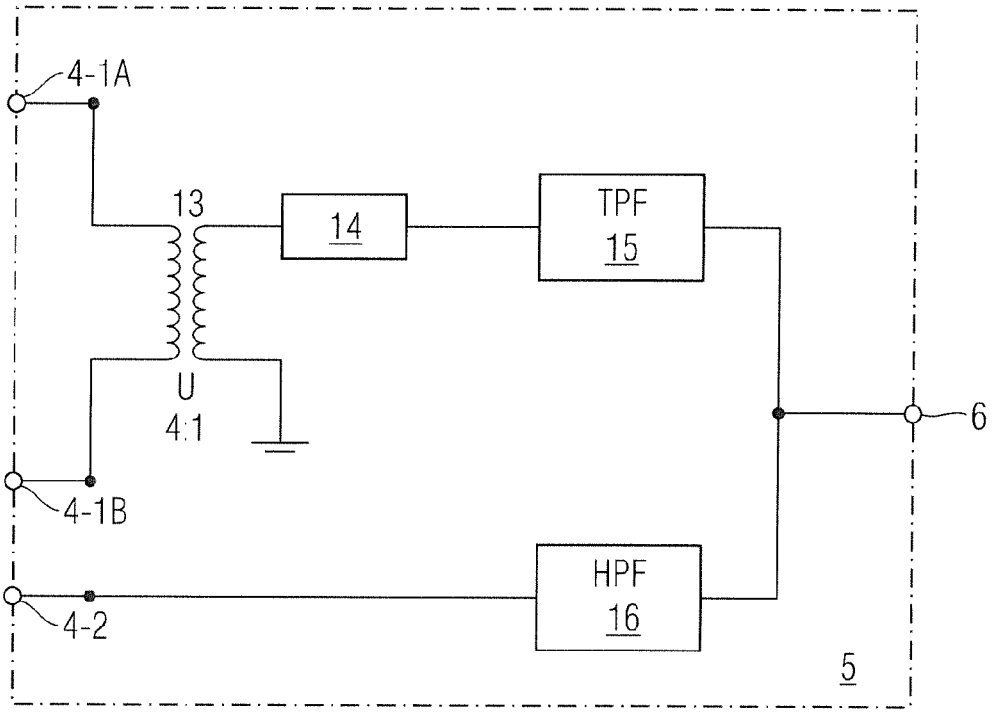
FIG. 4 is a block diagram of a possible embodiment of a passive frequency multiplexing unit which can be used in the directional antenna module according to the invention.

FIG. 4 is a block diagram representing an embodiment of a passive frequency multiplexing unit 5 which can be used in the directional antenna module 1 according to the invention. The passive frequency multiplexing unit 5 has a first input gate 4-1A, 4-1B for connecting a loaded loop antenna 2-1 and a second input gate 4-2 for connecting a further directional antenna 2-2, for example a logarithmic-periodic antenna. In the example shown, the passive frequency multiplexing unit 5 contains a transformer 13 for connecting the first directional antenna or loop antenna 2-1. In the embodiment shown, the passive frequency multiplexing unit 5 further comprises a compensation unit 14 for compensating transit time differences between the antenna signals of the two directional antennae 2-1, 2-2 at the input gates. In the embodiment shown in FIG. 4, the compensation unit 14 is provided between the transformer and a low-pass filter 15 of the passive frequency multiplexing unit 5. The passive frequency multiplexing unit 5 further comprises a high-pass filter 16, which high-pass-filters the antenna signal received from the second directional antenna 2-2 via the second input gate 4-2. The deep pass filter 15 carries out deep-pass filtering of the optionally time-delayed antenna signal received from the first directional antenna or loop antenna 2-1 via the first input gate 4-1A, 4-1B. The two filter units 15, 16 are connected at the output side, for example via high-frequency lines in the form of micro-strips, to the output gate 6 of the passive frequency multiplexing unit 5. As a result of the output unit 14, transit time differences between the two antenna outputs of the two directional antennae 2-1, 2-2 are compensated. These transit time differences represent a phase shift in the frequency range. The compensation unit 14 thus ensures that destructive overlapping of the signals does not occur in the frequency overlap range.

Figure 1:
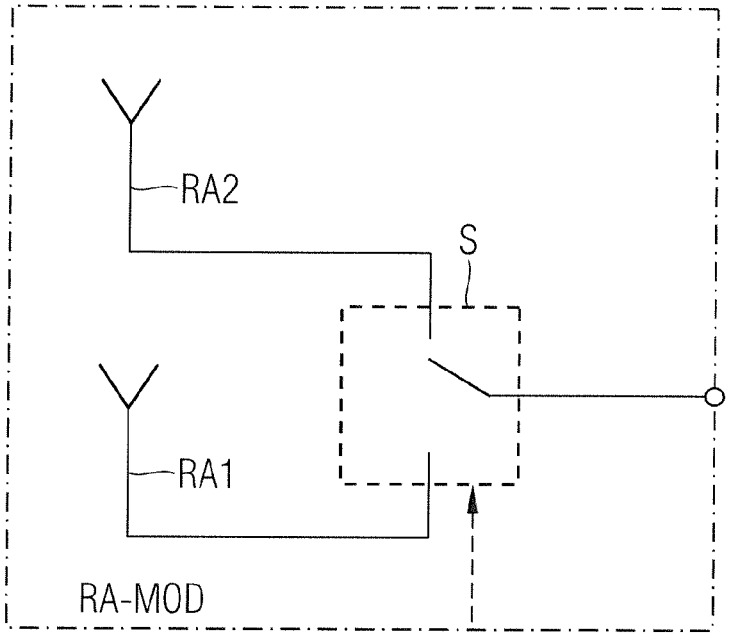
FIG. 1 shows a conventional directional antenna module comprising switchable directional antennae.
Figure 5:
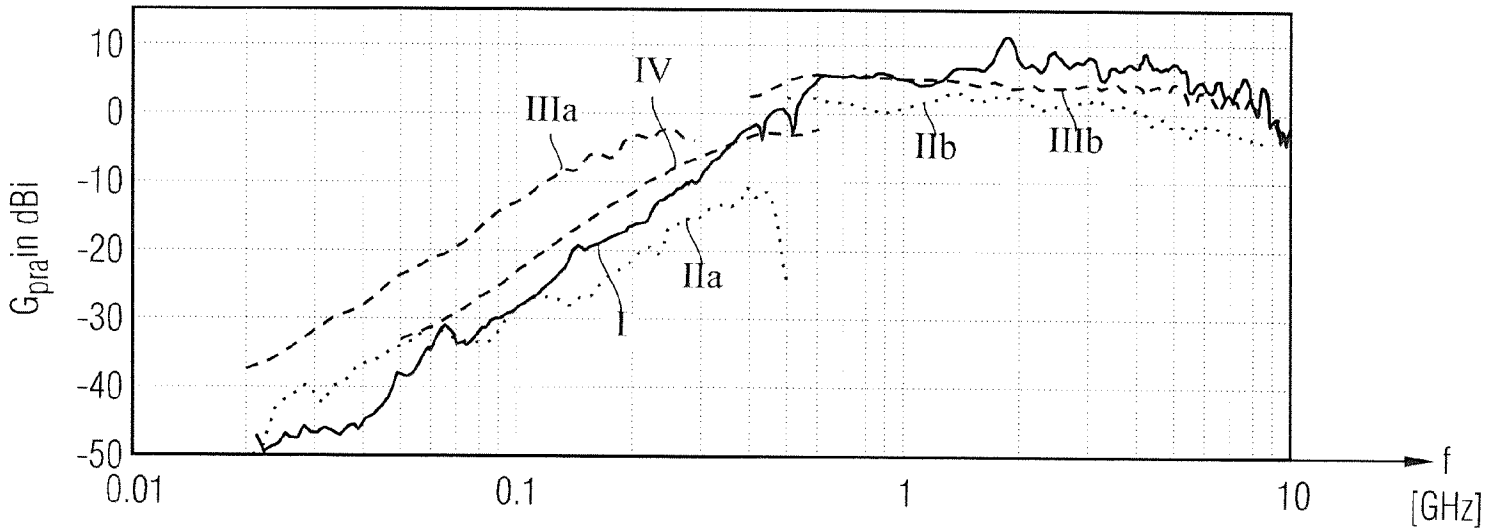
FIG. 5 is a signal diagram representing a signal gain of the directional antenna module according to the invention by comparison with conventional directional antenna modules.

FIG. 5 is a signal diagram representing an antenna signal gain of a directional antenna module 1 according to the invention by comparison with conventional directional antenna modules. The line I shows the continuous signal gain of the directional antenna module 1 according to the invention over the entire total frequency range extending over the VHF and UHF frequency ranges, whilst the lines IIa and IIb represent the signal gain in a switchable directional antenna module such as is shown in FIG. 1. FIG. 5 further represents exchangeable conventional switchable directional antenna modules, which are configured for specific frequency ranges, as lines IIIa and IIIb. As can be seen from FIG. 5, the directional antenna module 1 according to the invention has the advantage that it delivers a continuous signal gain over a very wide frequency range without a user having to switch between different frequency ranges. In particular at a boundary frequency of for example 500 MHz, the signal gain is continuous without switching, and corresponds in level to conventional replaceable directional antennae configured for different specific frequency subranges. As can be seen from lines IIa, IIb, the signal gain in a conventional switchable directional antenna module, as shown in FIG. 1, is discontinuous, and has a jump at a boundary frequency at which the switching takes place. If for example in the conventional directional antenna module the frequency increases to a boundary frequency of for example 500 MHz, the signal gain falls off strongly, in such a way that the signal gain is no longer sufficient for measurement in particular in the case of weak received signals. The directional antenna module 1 according to the invention thus has signal gain comparable to or even higher than conventional replaceable directional antennae. The measured signal gain progression of the directional antenna module 1 according to the invention permits a higher boundary frequency well beyond the UHF frequency range, up to 8 GHz being achievable. Further, the directional antenna module 1 according to the invention has a good directional characteristic, which is substantially cardioid-like. The cardioid characteristic is provided for the entire frequency range from the lowest to the highest frequency.

The invention claimed is:

1. A directional antenna module comprising at least two directional antennae contained in a housing of the directional antenna module, for adjacent frequency ranges, wherein the directional antennae are connected to a passive frequency multiplexing unit, which multiplexes the antenna signals received from the directional antennae in the various frequency ranges into a wideband signal, wherein the passive frequency multiplexing unit has input gates for the antenna signals received by the directional antennae and an output gate for emitting the wideband signal, and wherein the first directional antenna is connected to a first input gate of the passive frequency multiplexing unit, and the second directional antenna is connected to a second input gate of the passive frequency multiplexing unit.

2. The directional antenna module according to claim 1, wherein the directional antenna module has a substantially cardioid-like directional characteristic continuously over the various frequency ranges.

3. The directional antenna module according to claim 1, wherein a signal receiver or a spectrum analyser for evaluating the wideband signal is directly connectable to the output gate of the passive frequency multiplexing unit.

4. The directional antenna module according to claim 1, wherein a first directional antenna for receiving a VHF signal and a second directional antenna for receiving a UHF signal are contained in the housing of the directional antenna module.

5. The directional antenna module according to claim 1, wherein the first directional antenna comprises a loop antenna and/or a dipole antenna array.

6. The directional antenna module according to claim 1, wherein the second directional antenna is a logarithmic-periodic antenna.

7. The directional antenna module according to claim 1, wherein the passive frequency multiplexing unit is a diplexer, the transition frequency of which corresponds to the boundary frequency of the adjacent frequency ranges.

8. The directional antenna module according to claim 1, wherein the passive frequency multiplexing unit comprises a low-pass filter for low-pass filtering of the antenna signal received from the first directional antenna via the first input gate and a high-pass filter for high-pass filtering of the antenna signal received from the second directional antenna via the second input gate.

9. The directional antenna module according to claim 8, wherein a transformer for connecting the first directional antenna is provided between the first input gate of the passive frequency multiplexing unit and the low-pass filter.

10. The directional antenna module according to claim 1, wherein the passive frequency multiplexing unit comprises a compensation unit for compensating transit time differences between the antenna signals of the two directional antennae at the input gates of the passive frequency multiplexing unit.

11. The directional antenna module according to claim 5, wherein, in the loop antenna which forms the first directional antenna of the directional antenna module, a resistor is interconnected which gives the loop antenna a directional characteristic.

12. The directional antenna module according to claim 1, wherein the first directional antenna and the second directional antenna are provided in a shared portable plastics material housing.

* * * * *